United States Patent [19]

Salice

[11] Patent Number: 5,076,712

[45] Date of Patent: Dec. 31, 1991

[54] TRACK FOR GUIDING DRAWERS

[75] Inventor: Luciano Salice, Carimate, Italy

[73] Assignee: Arturo Salice S.p.A., Novedrate, Italy

[21] Appl. No.: 543,875

[22] Filed: Jun. 26, 1990

[30] Foreign Application Priority Data

Jul. 16, 1989 [DE] Fed. Rep. of Germany ..... 3922252
Jul. 18, 1989 [DE] Fed. Rep. of Germany ..... 3923776

[51] Int. Cl.[5] ..... A47B 88/10
[52] U.S. Cl. ..... 384/19
[58] Field of Search ..... 384/18-23; 312/341 R

[56] References Cited

U.S. PATENT DOCUMENTS

| | | | |
|---|---|---|---|
| 3,485,539 | 12/1969 | Fall et al. | 384/19 |
| 4,077,677 | 3/1978 | Sekerich | 384/19 |
| 4,315,661 | 2/1982 | Kessler | 384/19 X |
| 4,564,248 | 1/1986 | Grass | 384/19 |
| 4,759,341 | 7/1988 | McFarland | 384/23 X |
| 4,952,074 | 8/1990 | Röck | 384/19 |

FOREIGN PATENT DOCUMENTS

| | | |
|---|---|---|
| 0219733 | 10/1986 | European Pat. Off. . |
| 2241943.8 | 8/1972 | Fed. Rep. of Germany . |
| 2735248.3 | 8/1977 | Fed. Rep. of Germany . |
| 8031489.2 | 11/1980 | Fed. Rep. of Germany . |
| 3207972.9 | 3/1982 | Fed. Rep. of Germany . |
| 3405802.8 | 2/1984 | Fed. Rep. of Germany . |

*Primary Examiner*—Thomas R. Hannon
*Attorney, Agent, or Firm*—Fleit, Jacobson, Cohn, Price, Holman & Stern

[57] ABSTRACT

This invention relates to a track for guiding drawers or the like, comprising at least one pair of rails, which are provided on each of two mutually opposite side faces of the drawer and consist of a corpus rail and a drawer rail, and a roller, which is provided at one end of the corpus rail and/or of the drawer rail and rolls on a horizontal flange of the opposite rail. Rails of four different types are required in known tracks of that kind. In order to simplify the manufacture and stockkeeping of the rails of such tracks and to reduce the expenditure involved in such manufacture and stockkeeping, the drawer rails consist of identical rails, which have mirror symmetry with respect to their transverse center line and are provided with rollers at both ends.

8 Claims, 2 Drawing Sheets

TRACK FOR GUIDING DRAWERS

BACKGROUND OF THE INVENTION

1. Field of the Invention

This invention relates to a track for guiding drawers or the like, comprising at least one pair of rails, which are provided on each of two mutually opposite side faces of the drawer and consist of a corpus rail and a drawer rail, and a roller, which is provided at one end of the corpus rail and/or of the drawer rail and rolls on a horizontal flange of the opposite rail.

2. Description of the Prior Art

Such tracks for guiding drawers are known from Published German Application 34 05 802 and comprise two track rails provided on the corpus and two extractable rails which are slidable in said track rails. The track rails on the corpus are channel-shaped and the extractable rails are Z-shaped in cross-section. The horizontal flanges of said rails may be flat or profiled and each of said flanges constitutes a runway for constraining the movement of the roller at the end of the opposite rail. Said rollers are rotatably mounted at the forward end of the track rail or corpus rail and at the rear end of the drawer rail or extractable rail. That design calls for four different rails for each track so that the track rails and the extractable rails which are required for the left-hand side of the track cannot be provided on the right side and vice versa and four different parts must be manufactured and kept in stock for each track.

Tracks of the present kind are also known from German Utility Model 80 31 489 and comprise corpus rails and drawer rails which with the exception of the end portion have an identical channel shape. In that case too a roller is provided at the forward end of the corpus rail and at the rear end of the drawer rail. Each drawer rail is provided with lugs, which are formed on the vertical web of the drawer rail and have a bore for receiving a fixing screw. Owing to those different features of the rails which have basically the same shape in cross-section, that prior art also calls for four different rails for each track. The manufacture and the stockkeeping are expensive and the mounting of the several rails is difficult because they must either distinctly be marked to indicate the position in which they are to be mounted or complicated operations must be performed to find by trial and error which rail is to be arranged in what position in order to provide the track.

SUMMARY OF THE INVENTION

For this reason it is an object of the invention to provide a track which is of the kind described first hereinbefore and is improved so that it can be manufactured at lower cost and, in particular, can be mounted more easily.

That object is accomplished in accordance with the invention in that the corpus rails and the drawer rails consist of identical rails, which have mirror symmetry with respect to their transverse center line and are provided with rollers at both ends.

The advantage afforded by such track resides in that all rails to be manufactured may be of the same type instead of the four types of rails which were previously required. This permits, e.g., a substantial decrease of the costs of the tooling for manufacturing the rails. The stockkeeping is also simplified. Finally, the mounting is simple because the rails of each type can be rotated to a position for use as a corpus rail and as a drawer rail on the left and right sides of a drawer.

Except for the end portions provided with the rollers, each rail preferably comprises a first horizontal flange and a second horizontal flange, which is opposite to the first flange, so that the rail is channel-shaped. The second horizontal flange may be bent along its outer edge through about 90 degrees toward the first horizontal flange so that a track groove is provided for the roller which rolls on that horizontal flange and a lateral slipping of that roller will be prevented.

At each of its ends spaced apart along the rail, the just described first horizontal flange may be provided with a positively acting stop, which is preceded by a non-positively acting stop. In that case the positively acting stop will prevent an inadvertent removal of the drawer from the associated track and the non-positively acting stop will permit the extracted drawer to be retained in a quasistable position. The two stops define an intervening depression, which when the track has been extracted will receive the roller that rolls on the second horizontal flange.

In a preferred embodiment the first horizontal flange may be provided near its ends with guide-in ramps, which permit the drawer provided with the drawer rails to be removed from the associated corpus rails because the drawer and the drawer rails can be pivotally moved so that the ramp provided on the first horizontal flange will guide the roller, which then bears on the positively-acting stop, around said positively acting stop.

The rail may desirably be provided with longitudinally extending reinforcing ribs so that the wall thickness of the profiled rail may be reduced without a resulting loss in strength.

The rail is desirably provided in a vertical web with longitudinal and transverse slots. For an adjustment of the track in depth as the track is mounted, the fixing screws may be inserted only through the longitudinal slots. An adjustment in height will be permitted if the fixing screws are inserted only through the transverse slots.

DETAILED DESCRIPTION OF THE PREFERRED EMBODIMENT

Figure 1:
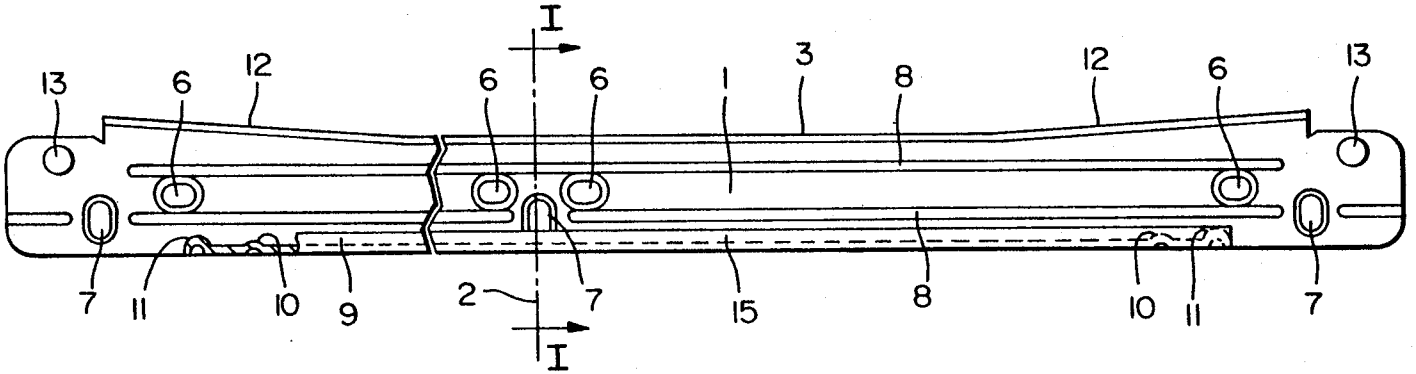
FIG. 1 is a side elevation showing a single rail of a track in accordance with the invention.

Futher details and advantages of the invention will be explained with reference to an illustrative embodiment shown in the drawing.

Figure 2:
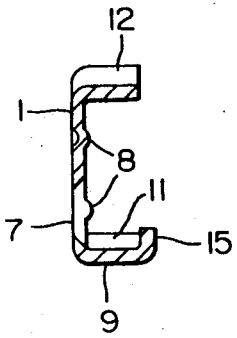
FIG. 2 is a transverse sectional view taken on line I—I in FIG. 1.

The rail 1 shown in FIG. 1 has mirror symmetry about its transverse center line 2 and comprises a first horizontal flange 3 and a second horizontal flange 9 so that the rail is substantially channel-shaped (see FIG. 2).

The second horizontal flange 9 of the rail 1 has an outer edge 15 and is bent about said edge 15 through 90 degrees toward the first horizontal flange 3 to form a groove, as is particularly apparent from FIG. 2. A positively acting stop 11 is provided at each end of the second flange and is preceded by a non-positively acting stop 10. As is apparent from the sectional part of FIG. 1, the associated stops 10 and 11 define an intervening depression in the horizontal flange.

The first flange 3 is opposite to the second flange 9 of the rail 1 and is provided near each end with a longitudinal guide-in ramp 12. The end portions of the rail 1 are formed with bores 13, which are used to mount two rollers, which are not shown in FIG. 1. The bores 13 are eccentric to the longitudinal center line of the rail 1 and are closer to the first flange 3 than said center line.

The rail 1 is provided with longitudinal reinforcing ribs 8 and is formed in a vertical web with longitudinal slots 6 and with transverse slots 7 extending at right angles to the longitudinal direction of the rail. The slots 6 and 7 are adapted to receive fixing screws, not shown.

Figure 3:
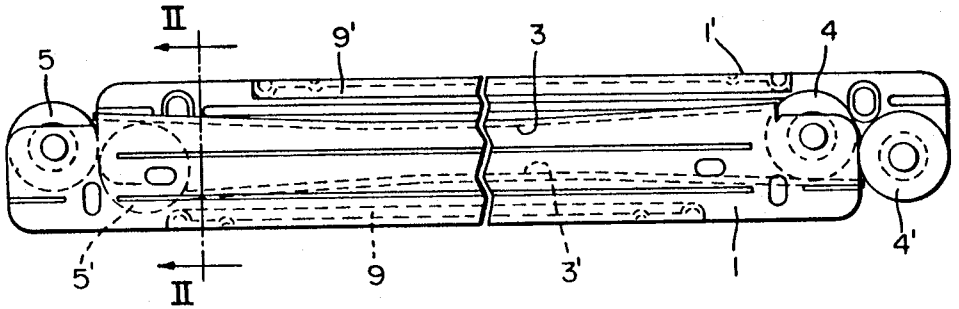
FIG. 3 is a side elevation showing two interfitted rails with the drawer rail viewed from its mounting side.
Figure 4:
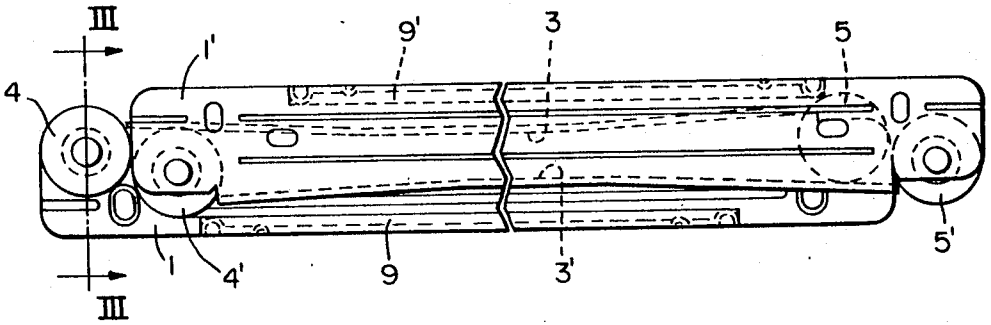
FIG. 4 is a side elevation showing two interfitted rails with the corpus rail viewed from its mounting side.

The mode of operation of the rails 1 of the track and particularly the manner in which they cooperate with each other will now be explained with reference to FIGS. 3 to 6. FIG. 3 shows, e.g., a set of rails which may be provided on the left side of a drawer, as is indicated in the diagrammatic sectional view of FIG. 6. A drawer 16 is screwed to the drawer rail 1. The corpus rail 1' is secured to the corpus 17 of a piece of furniture. FIG. 4 shows the right side of such a track. In accordance with the prior art, four different rails are required for the tracks shown in FIGS. 3 and 4. In the track in accordance with the invention all four tracks 1 and 1' provided on the left and right sides of the drawer may be of the same type, which has been described more in detail hereinbefore with reference to FIG. 1.

FIG. 3 shows the rollers 5 and 4 of the drawer rail 1 and the rollers 5' and 4' of the corpus rail 1'. As is apparent from FIG. 3 the roller 4 is disposed outside the horizontal flange 9' of the corpus rail 1' when the drawer rail has been entirely retracted. In that position and during a small extraction of the drawer the load of the drawer is applied via the roller 4 to the lower flange 3'. After an extraction over a certain distance, the load exerted by the drawer will impart to the drawer rail 1 a pivotal movement about the forward roller 5' so that the roller 4 is now moving along the second horizontal flange 9' of the corpus rail 1' in the groove which has been described hereinbefore with reference to FIG. 2. The roller 5' is now rolling on the first horizontal flange 3 of the drawer rail 1. In the arrangement which is shown in FIG. 3 and in which the two rails constitute the left-hand part of the track the roller 5 of the drawer rail 1 and the roller 4' of the corpus rail 1' are not required for the operation of the track.

FIG. 4 shows the set of rails for the right side of a track. That arrangement will be obtained if each rail of the set shown in FIG. 3 is inverted through 180° about its longitudinal axis and through 180° about its transverse center line 2. In the position shown in FIG. 4 the roller 5 of the fully retracted drawer rail is disposed outside the horizontal flange 9' of the corpus rail 1'. In that position and during a small extraction the load of the drawer is applied via the roller 4 to the lower flange 3'. After an extraction over a certain distance, the load of the drawer will impart to the drawer rail 1 a pivotal movement about the forward roller 4' so that the roller 5 is now rolling along the second horizontal flange 9' of the corpus rail 1' while the roller 4' of the corpus rail 1' is rolling on the first horizontal flange 3 of the drawer rail 1. In the arrangement shown in FIG. 4 used as the right-hand part of a track for a drawer the roller 4 of the drawer rail 1 and the roller 5' of the corpus rail 1' do not perform a function.

Figure 5:
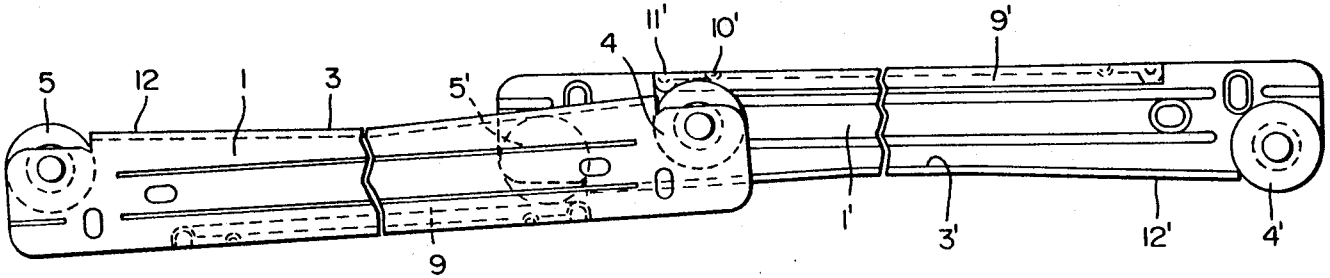
FIG. 5 shows two rails of the track in accordance with the invention in an arrangement which is similar to that of FIG. 3 but with the drawer rail shown in its fully extracted position.
Figure 6:
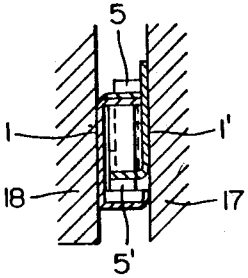
FIG. 6 is a sectional view which is taken on line II—II in FIG. 3 and in addition to the rails shown in section indicates a drawer and a corpus.

The rails 1 and 1' shown in FIG. 5 constitute the left-hand part of a track like the rails shown in FIG. 3. But the roller 4 of the drawer rail 1 is disposed in the depression that is defined by the stops 11' and 10' of the second horizontal flange 9' of the corpus rail 1'. That position will be assumed when the drawer has entirely been extracted.

When it is intended to remove the drawer with its two drawer rails from the track, a pivotal movement about the rollers 5' on the right-hand and left-hand corpus rails 1' will be imparted to the drawer provided with the drawer rails so that the rollers 4 on the left-hand and right-hand drawer rails are pivotally moved out of the above-described depression and toward the guide-in ramp 12'. As the drawer provided with the drawer rails is then extracted further the rollers 4 can move past the positively acting stop 11'. With that design an unintended extraction of the drawer from the track will be prevented but the drawer can entirely be removed from the track when this is desired if a simple pivotal movement is imparted to the drawer.

Owing to the guide-in ramps 12, the drawer will automatically be moved to its entirely retracted position, as has already been disclosed, e.g., in Published German Application 34 05 802.

Figure 7:
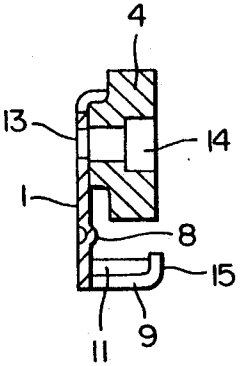
FIG. 7 is a sectional view taken on line III—III in FIG. 4.

FIG. 7 shows more in detail that the roller 4 is rotatably mounted on the rail 1 on a pin 14, which is non-rotatably held in a mating bore 13 of the rail 1.

What is claimed is:

1. In a track for guiding extendable apparatus, comprising at least one pair of rails, which are provided on each of two mutually opposite side faces of the extendable apparatus and including a corpus rail and a drawer rail, and a roller, which is provided at one end of one of the corpus rail and the drawer rail and which rolls on a horizontal flange of the opposite rail, the improvement comprising the corpus rails and the drawer rails being identical rails, which have mirror symmetry with respect to their transverse center line and are provided at both ends with means to attach to a roller.

2. A track according to claim 1, characterized in that, except for the end portions provided with the rollers, each rail comprises a first horizontal flange and a second horizontal flange, which is opposite to the first flange, so that the rail is channel-shaped.

3. A track according to claim 2, characterized in that the second horizontal flange is bent along its outer edge through about 90 degrees toward the first horizontal flange.

4. A track according to claim 2, characterized in that the second horizontal flange of each rail is provided with a positively acting stop at each of its ends.

5. A track according to claim 4, characterized in that the second horizontal flange is provided with non-positively acting stops, each of which precedes one of the positively acting stops.

6. A track according to claim 2, characterized in that the first horizontal flange is provided near its ends with guide-in ramps extending in the longitudinal direction of each rail.

7. A track according to claim 1, characterized in that each rail is provided with longitudinal reinforcing ribs.

8. A track according to claim 1, characterized in that each rail is provided in a vertical web with slots, which extend in the longitudinal direction of the rail, and with slots which extend at right angles to said direction.

* * * * *